US006933894B2

(12) United States Patent
Ghosh et al.

(10) Patent No.: US 6,933,894 B2
(45) **Date of Patent: *Aug. 23, 2005**

(54) MULTIBAND MICROWAVE ANTENNA

(75) Inventors: Indra Ghosh, Köln (DE); Achim Hilgers, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/729,251

(22) Filed: Dec. 5, 2003

(65) Prior Publication Data

US 2004/0119648 A1 Jun. 24, 2004

Related U.S. Application Data

(63) Continuation of application No. 09/973,314, filed on Oct. 9, 2001, now Pat. No. 6,683,571.

(30) Foreign Application Priority Data

Oct. 9, 2000 (DE) ..... 100 49 845

(51) Int. Cl.[7] ..... H01Q 1/38
(52) U.S. Cl. ..... 343/700 MS
(58) Field of Search ..... 343/702, 700 MS, 343/845, 846, 895

(56) References Cited

U.S. PATENT DOCUMENTS

| | | | | | |
|---|---|---|---|---|---|
| 5,767,811 | A | | 6/1998 | Mandai et al. | 343/702 |
| 5,790,078 | A | | 8/1998 | Suzuki et al. | 343/700 MS |
| 5,945,951 | A | * | 8/1999 | Monte et al. | 343/700 MS |
| 5,999,146 | A | * | 12/1999 | Kanba et al. | 343/895 |
| 6,281,848 | B1 | | 8/2001 | Nagumo et al. | 343/700 M |
| 6,288,677 | B1 | | 9/2001 | Fink | 343/700 MS |
| 6,545,641 | B2 | * | 4/2003 | Ghosh et al. | 343/700 MS |
| 6,680,700 | B2 | * | 1/2004 | Hilgers | 343/700 MS |
| 6,693,604 | B2 | * | 2/2004 | Washiro et al. | 343/895 |

* cited by examiner

*Primary Examiner*—Don Wong
*Assistant Examiner*—Huedung X. Cao
(74) *Attorney, Agent, or Firm*—Dicran Halajian

(57) ABSTRACT

Microwave antennas with a dielectric substrate (1) and at least one resonant conductor track structure (31 to 39) are described, which are particularly suitable for mobile dual-band and multiband telecommunication devices such as mobile and cellular telephones, as well as for devices which communicate in accordance with the Bluetooth standard. In addition, attuning of the resonance frequencies of various operating modes to a concrete constructional situation is possible thanks to various line segments (34, 35) and tuning stub lines (41, 42) without the necessity of changing the fundamental antenna design. Finally, the antennas may be soldered together with other components onto a printed circuit board in a conventional surface mounting process.

20 Claims, 3 Drawing Sheets

MULTIBAND MICROWAVE ANTENNA

Figure 1:
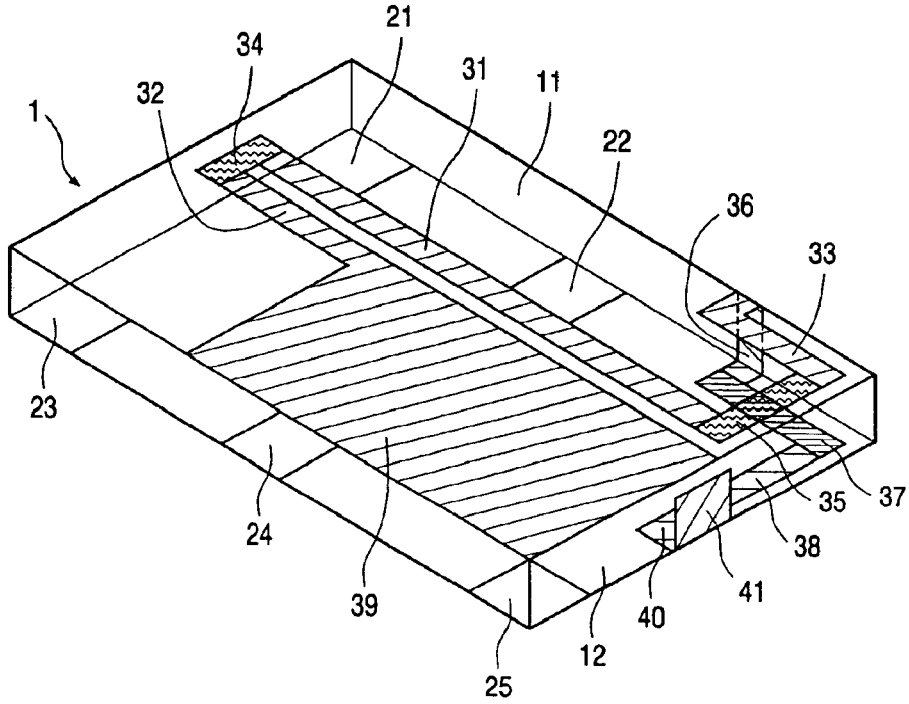

This is a continuation of application Ser. No. 09/973,314, filed Oct. 9, 2001, now U.S. Pat. No. 6,683,571.

The invention relates to a microwave antenna with a substrate with at least one resonant conductor track structure, designed in particular for mobile dual-band or multiband telecommunication devices such as mobile and cellular telephones, as well as for devices which communicate in accordance with the Bluetooth standard. The invention further relates to a printed circuit board with such an antenna and to a telecommunication device with such an antenna.

Electromagnetic waves in the microwave range are used in mobile telecommunication for the transmission of information. The GSM mobile telephone standard is used exclusively in Europe and in a majority of the rest of the world for cellular systems. Within this GSM standard there are several frequency bands in which the communication may take place: on the one hand from 880 to 960 MHz (the so-called GSM900) and on the other hand from 1710 to 1880 MHz (the so-called GSM1800 or DCS). A third band, which is mainly used in the USA, uses frequencies from 1850 to 1990 MHz (GSM1900 or PCS).

Usually a network service provider will offer his services in only one of these frequency bands. Increasingly, however, mobile telephones are constructed such that they can operate in several frequency bands so as to safeguard a wide covering range and to provide a universal operation possibility for the mobile telephones in any location whatsoever, independently of the conditions prevailing locally and the networks operated locally. These mobile telephones are also referred to as dual-band or multiband mobile telephones. A precondition for this is, however, that the antenna of such a mobile telephone is capable of transmitting and receiving electromagnetic waves in the respective two or more frequency bands.

A further standard which was recently developed is the so-called Bluetooth standard (BT) for which the frequency range from 2.4 to 2.48 GHz is reserved and which serves for the exchange of data between, for example, mobile telephones and other electronic devices such as, for example, computers, other mobile telephones, etc.

Furthermore, the market shows a strong trend towards miniaturization of the devices. This results in the wish also to reduce the components for the mobile communication, i.e. the electronic components, in size. The antenna types used at present in mobile telephones, which are usually wire antennas, have substantial disadvantages in this respect, because they are comparatively large. They project from the mobile telephones, may readily break off, may come into undesirable eye contact with the user, and also stand in the way of an aesthetic design. Increasingly, moreover, an undesirable microwave irradiation of the user by the mobile telephone has become a subject of public discussion. A major portion of the emitted radiation power may be absorbed in the user's head in the case of wire antennas which project from the mobile telephone.

Surface mounting (with SMDs or surface mounted devices), i.e. the planar soldering of electronic components onto a PCB or printed circuit board by means of a wave soldering bath or a reflow soldering process, has become common practice in the technical realization of modern digital electronic devices. The antennas used until now, however, are not suitable for this mounting technology, because they often can only be provided on the printed circuit board of the mobile telephone by means of special supports, while also the supply of electromagnetic power is only possible by means of special supply/support members such as pins or the like. This causes undesirable mounting steps, quality problems, and additional cost in production.

Efforts are made to come to terms with these very different requirements and problems through an optimized antenna design. It should be taken into account here that in particular the structure of the antenna is more strongly dependent on the desired frequency range and the application of the relevant electronic device than that of any other HF component, because the antenna is a resonant component which is to be attuned to the respective operating frequency range. In general, conventional wire antennas are used for transmitting and receiving the desired information. Certain physical lengths are absolutely necessary if good radiation and reception conditions are to be achieved for this type of antennas. So-called $\lambda/2$ dipole antennas ($\lambda$=wavelength of the signal in the open space) were found to be particularly advantageous in this respect, which antennas are formed by two wires, each $\lambda/4$ long, which are mutually rotated through 180°. Since these dipole antennas are too large for many applications, however, in particular for mobile telecommunication (the wavelength for the GSM900 range is, for example, approximately 32 cm), alternative antenna structures are utilized. A widely used antenna in particular for the mobile telecommunication bands is the so-called $\lambda/4$ monopole which is formed by a wire with a length of $\lambda/4$. The radiation behavior of this antenna is acceptable while at the same time its physical length (approximately 8 cm for GSM900) is satisfactory. This type of antenna in addition is characterized by a great impedance and radiation bandwidth, so that it can also be used in systems which require a comparatively great bandwidth such as, for example, mobile telephone systems. To achieve an optimum power adaptation to 50 Ω, a passive electrical adaptation is used for this type of antenna (as is also the case for most $\lambda/2$ dipoles). This adaptation is usually formed by a combination of at least one coil and a capacitance, which adapts the input impedance different from 50 Ω to the connected 50 Ω components by means of a suitable dimensioning.

A further possibility is to achieve a miniaturization of this antenna through the use of a medium having a dielectric constant $\in_r>1$, because the wavelength is reduced by a factor $1/\subset\in_r$ in such a medium.

An antenna of this type comprises a solid block (substrate) of a dielectric material. A metal conductor track is printed on this block. This conductor track is capable of radiating energy in the form of electromagnetic waves upon reaching an electromagnetic resonance. The values of the resonance frequencies depend on the dimensions of the printed conductor tracks and the value of the dielectric constant of the block. The values of the individual resonance frequencies drop with an increase in the length of the conductor track and with an increase in the value of the dielectric constant.

To achieve a high degree of miniaturization of the antenna, accordingly, a material with a high dielectric constant will be chosen, and the mode with the lowest frequency will be chosen from the resonance spectrum. This mode is designated the base or fundamental mode, the next higher mode with respect to the resonance frequency is denoted the first harmonic. Such an antenna is also referred to as printed wire antenna. The bandwidth of such a known antenna is satisfactory in the case of resonance frequencies which lie in the region covered by the GSM standard only for achieving a full coverage of one of the frequency bands of the GSM standard. The dual-band or multiband applications mentioned above are accordingly not possible here.

It is an object of the invention, therefore, to provide a microwave antenna which is suitable for said dual-band or multiband applications and which has dimensions which are as small as possible.

Furthermore, a microwave antenna is to be provided which can be mounted by the SMD technology through planar soldering and contacting on the conductor tracks—possibly together with other components of the printed circuit board—without additional supports (pins) for the supply of the electromagnetic power being necessary.

The invention also has for its object to provide a microwave antenna whose resonance frequencies can be individually adjusted without changes in the basic antenna design such that they can be attuned to a given constructional situation.

Finally, a microwave antenna is to be provided whose input impedance can also be individually adapted to a given constructional situation.

To achieve these objects, a microwave antenna is provided with a substrate having at least one resonant conductor track structure, characterized in accordance with claim 1 in that a first conductor track structure is formed by at least a first and a second conductor portion, which extend in a substantially meandering shape, and in that the two conductor portions have a distance that determines the frequency distance between the first resonance frequency of the fundamental mode and the second resonance frequency for the first harmonic of the fundamental mode can be adjusted through a change in the distance between the two conductor portions.

A particular advantage of this solution is that the frequency of the fundamental mode can be adjusted by means of the total length of the conductor track structure, and the frequency distance between the fundamental mode and the first harmonic can be adjusted by means of said distance such that the antenna can be operated as a dual-band antenna in the GSM900 and GSM1800 bands.

The dependent claims define advantageous further embodiments of the invention.

The embodiments of claims 2 and 3 have the advantage that the frequency distance can be adjusted even better.

The embodiment of claim 4 has the advantage that a surface mounting of the antenna together with other components on a printed circuit board is possible, so that the manufacture can be substantially simplified and quickened.

The embodiment of claim 5 renders possible an independent adjustment of the frequency of the fundamental mode or the first harmonic without the other one of these two frequencies being appreciably influenced.

The embodiment of claim 6 has the advantage that the antenna can even be operated in three frequency bands, while according to claim 7 a supply through a joint feed terminal is possible.

A tuning of the individual resonance frequencies of this three-band antenna can be carried out in the embodiments of claims 8 and 9.

Figure 2:
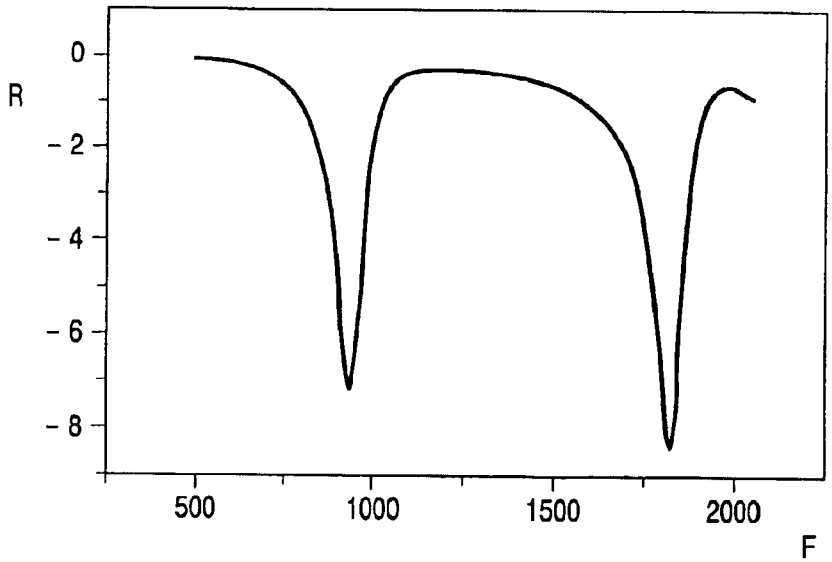
Figure 3:
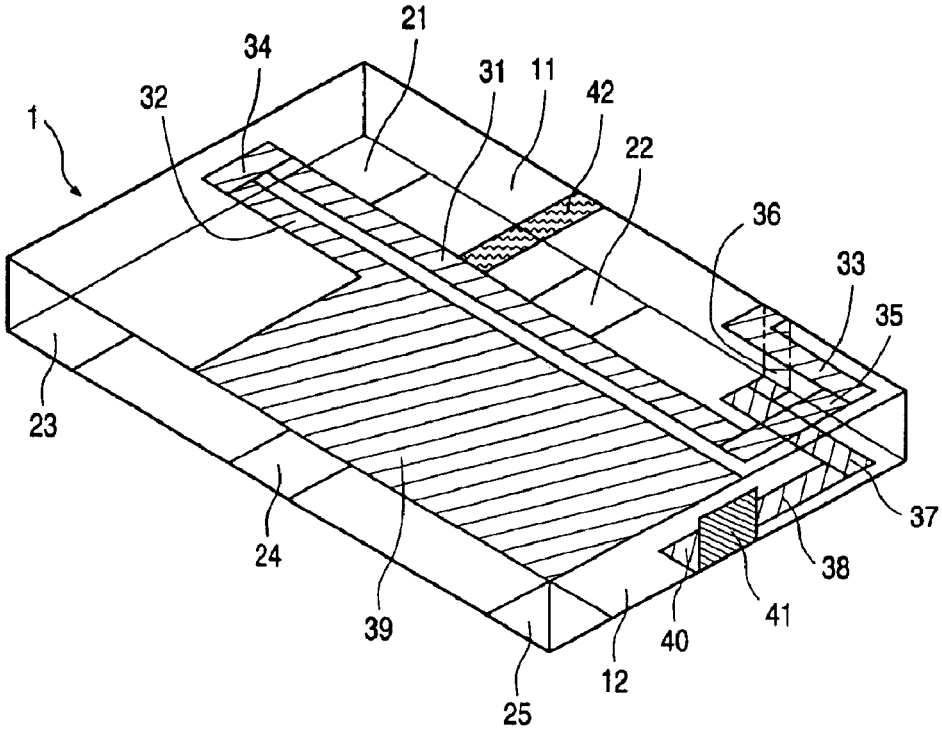
Figure 4:
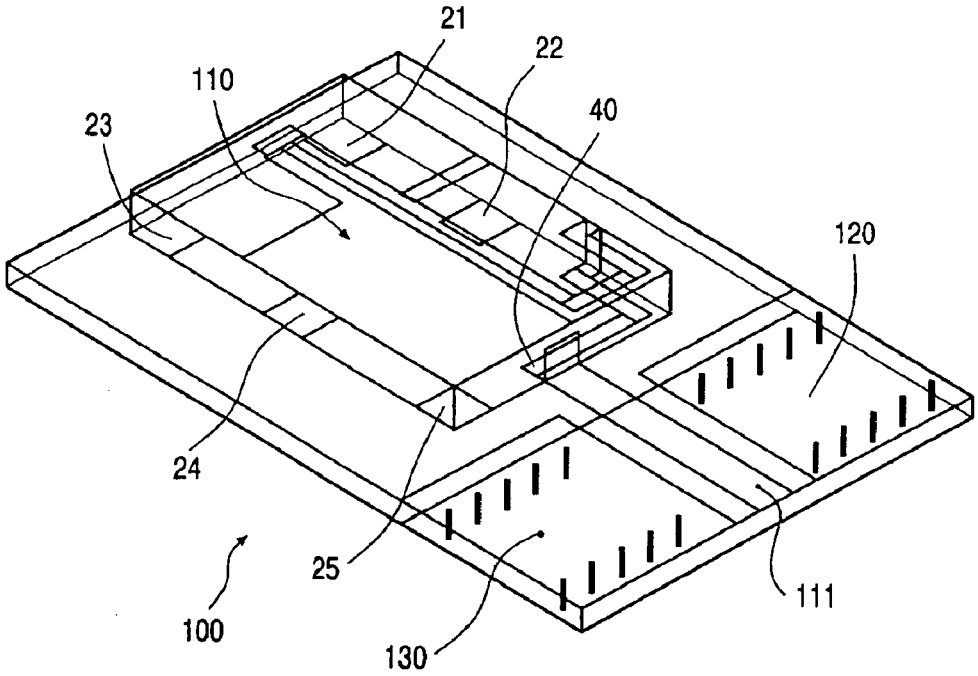
Figure 5:
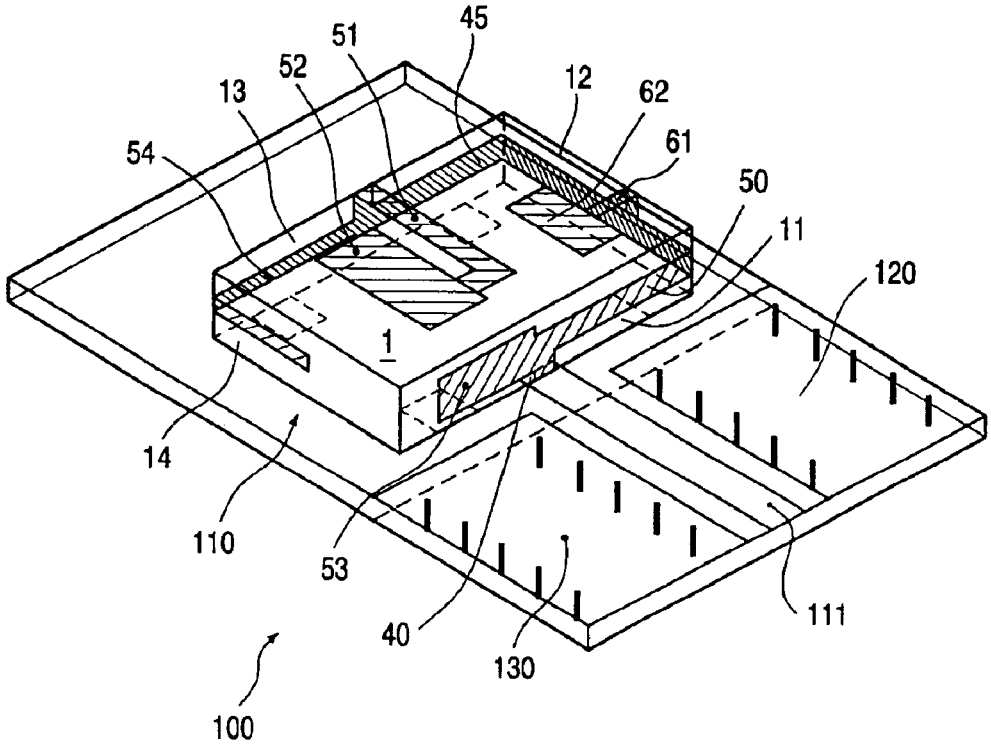
Figure 6:
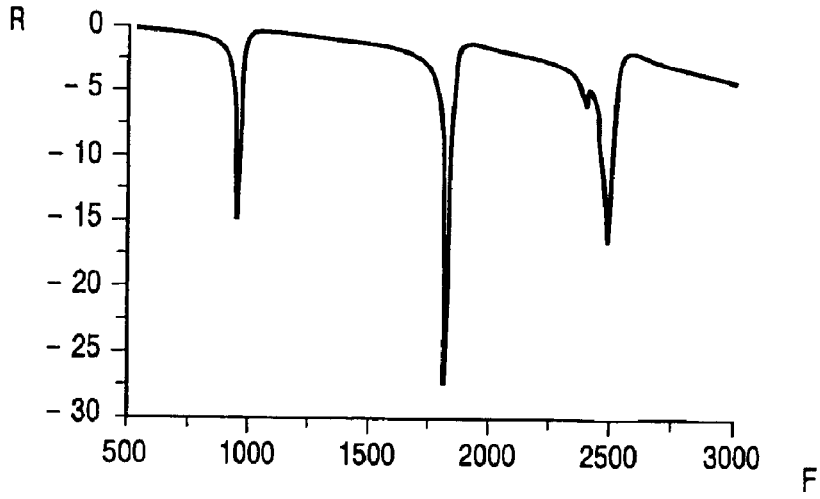

Further particulars, characteristics, and advantages of the invention will become apparent from the following description of preferred embodiments, given with reference to the drawing, in which:

FIG. 1 diagrammatically shows a first antenna according to the invention;

FIG. 2 is a reflection diagram measured for the antenna;

FIG. 3 diagrammatically shows a second antenna according to the invention;

FIG. 4 shows the second antenna according to the invention on a printed circuit board;

FIG. 5 diagrammatically shows a third antenna according to the invention on a printed circuit board; and FIG. 6 is a reflection diagram measured for the third antenna.

The antennas described are basically printed wire antennas where a conductor track is provided on a substrate. These antennas are accordingly wire antennas in principle, which in contrast to microstrip antennas do not have a metal surface on the rear of the substrate which acts as a reference potential.

The embodiments to be described below comprise a substrate consisting of a substantially rectangular block whose height is approximately a factor 3 to 10 smaller than the length or width. Accordingly, the following description will refer to the upper and lower (larger) surfaces of the substrate as shown in the Figures as the first, upper and the second, lower surface, while the surfaces perpendicular thereto will be denoted the first to fourth side faces.

Alternatively, however, it is also possible to choose geometric shapes other than rectangular block shapes for the substrate, for example a cylindrical shape on which an equivalent resonant conductor track structure is provided, for example following a spiraling course.

The substrates may be manufactured by embedding a ceramic powder in a polymer matrix and have a dielectric constant of $\in_r>1$ and/or a permeability value of $\mu_r>1$.

In more detail, the antenna of FIG. 1 comprises a substrate 1 on whose surface a first conductor track structure 31–39 is provided, which structure is supplied via a feed terminal 40. Soldering points 21 to 25 are present at a lower surface of the substrate, also denoted footprints, by means of which the substrate 1 can be soldered to a printed circuit board (PCB) by means of surface mounting (SMD).

The conductor track structure is formed by a plurality of individual conductor portions printed on the substrate. In more detail, these are a first and a second portion 31, 32 which extend substantially parallel to and alongside the length of the upper surface of the substrate 1, the second portion 32 merging into a rectangular metal surface 39.

A third portion 33, which also extends in longitudinal direction of the substrate 1, is considerably shorter than the former. The first and second portions 31, 32 as well as the second and third portions 32, 33 are interconnected at their ends to a fourth and a fifth portion 34, 35, respectively, extending in the width direction of the substrate 1, resulting in a meandering arrangement of these portions 31 to 35.

At the first side face 11 of the substrate 1, shown on the right in FIG. 1, there is a sixth conductor portion 36 which achieves a connection between the third portion 33 and a seventh portion 37 lying on the lower surface of the substrate in the longitudinal direction thereof. This seventh portion 37 extends substantially parallel to the first and second portions 31, 32 towards the frontmost (second) side face 12 of the substrate as shown in FIG. 1 and has a length which corresponds substantially to the length of the third portion 33, which lies above it on the upper surface of the substrate 1, seen in perpendicular projection. An eighth portion 38 extending in the direction of the width of the substrate is connected to the seventh portion 37 and merges into the feed terminal 40 in the form of a metallization pad.

Electromagnetic energy is coupled into the antenna via the feed terminal 40 which lies on the lower surface of the substrate 1. For this purpose, the feed terminal is soldered onto a corresponding conductor track on the printed circuit board (FIGS. 4 and 5) in the surface mounting process. The feed terminal (or coupling means) need not necessarily lie at the second side face 12 of the substrate 1.

The feed terminal 40 merges into a first conductor segment 41, which will be explained in more detail further below, at the second side face 12.

The resonance frequencies of this antenna can be adjusted in a known manner by means of the total length of the printed conductor track structure. For the application of this embodiment, for example in a dual-mode mobile telephone, the lowest resonance frequency, i.e. the fundamental mode, is adjusted such that it corresponds to the lowest of the two frequencies at which the antenna is to be operated. The next higher resonance frequency, i.e. the first harmonic, should then be such that it corresponds to the higher operating frequency. This means that the frequency distance from the first harmonic to the fundamental mode must be adjusted in accordance with the distance between the two operating frequencies, while the frequency of the fundamental mode is to remain substantially unchanged.

This may be achieved through two mutually independent measures in the antenna according to the invention.

On the one hand, the distance of the first harmonic to the fundamental mode can be changed through a change in the distance between the first and the second conductor portion 31 and 32. For this purpose, the lengths of the fourth and fifth conductor portions 34, 35 are correspondingly increased or decreased. Alternatively, it is also possible to increase this distance by means of laser trimming, in particular in the case of built-in antennas, in that one or both conductor portions 31, 32 are partly removed along their mutually opposed edges by means of a laser beam.

On the other hand, this frequency shift may also be achieved through a change in the length of the seventh conductor portion 37 at the lower side of the substrate 1.

The frequency distance is qualitatively decreased with a decrease in the distance between the first and the second conductor portion 31 and 32 as well as through a shortening of the seventh conductor portion 37.

In a possible embodiment of this first antenna, the dimensions of the substrate 1 are approximately 17×11×2.0 $mm^3$. The material chosen for the substrate 1 has a dielectric constant $\in_r$=18.55 and a tan δ value of $1.17\times10^{-4}$. This corresponds approximately to the HF properties of a commercial NP0-K17 ceramic material ($Ca_{0.05}Mg_{0.95}Ti_{0.3}$ ceramic). The printed conductor track was manufactured from silver paste and has a total length of approximately 55.61 mm. The width of the conductor portions is approximately 0.75 mm, while the dimensions of the rectangular metal surface 39 at the end of the second conductor portion 32 are approximately 11.0×4.5 $mm^2$.

For a length of the seventh conductor portion 37 of, for example, 6.25 mm, the frequency distance of the first harmonic to the fundamental mode is approximately 820 MHz. A distance of 873 MHz arises from a length of this conductor portion 37 of 5.75 mm.

For a length of the fourth conductor portion 34, and thus a spacing between the first and the second conductor portion 31 and 32, of 3.0 mm, said frequency distance is 900 MHz, while a frequency distance of 878 MHz results from a length of the fourth conductor portion 34 of 2.5 mm. Such an antenna is accordingly suitable for a dual-band operation in the GSM900 and GSM1800 frequency bands.

FIG. 2 shows the ratio R between the power reflected at the antenna and the power supplied to the antenna (reflection coefficient) in dependence on the frequency F in MHz measured at the supply line 40 of this antenna. It is apparent that the two resonances lie within the GSM900 and GSM1800 bands and that in addition the bandwidth is also sufficient for an effective operation within both frequency bands.

Apart from the advantage of a possible surface mounting (SMD), which holds for all embodiments, this embodiment has the substantial additional advantage that the frequency distance from the first harmonic to the fundamental mode can be adjusted as desired.

FIG. 3 shows a second embodiment of the invention. In this Figure, identical or similar elements and components have been given the same reference numerals as in FIG. 1. Reference is accordingly made to the description of FIG. 1 in that respect, and only the differences will be discussed below.

In this embodiment with the first conductor track structure in accordance with FIG. 1, a second conductor segment 42 in the form of a stub line is present in addition to the first conductor segment 41, which stub line is present on the upper surface of the substrate 1 and extends from the first conductor portion 31 in a direction towards the first side face 11 of the substrate.

The resonance frequency of the antenna in the fundamental mode may be adjusted through a change in the length of the first conductor segment 41 in the direction towards the upper surface of the substrate 1. The frequency of the first harmonic is only slightly influenced by such an adjustment. Furthermore, the frequency of the first harmonic can be adjusted through a change in the length of the second conductor segment 42 in the direction of the first side face 11. This adjustment in its turn influences the frequency in the fundamental mode only slightly.

The effectivity of this adjustment of the resonance frequency in the fundamental mode is based on the fact that the electric field strength is comparatively great for the fundamental mode in the region of the first conductor segment 41, but is comparatively small for the first harmonic there, so that the latter remains substantially unaffected. A lengthening of the first conductor segment 41 thus leads to a strong influence on the resonance frequency in the fundamental mode. The frequency of the first harmonic remains substantially unaffected then.

In a similar manner, the second conductor segment 42 is designed and positioned such that it increases or decreases a volume with great electric field strength for the first harmonic, and thus shifts the harmonic in its frequency, while the fundamental mode remains substantially unaffected, because it only has a small electric field strength in the location in question.

The essential advantage of this embodiment is that the frequencies of the fundamental mode and the first harmonic can be individually adjusted independently of one another. Furthermore, the change in antenna design required for this is only small, and the antenna is fully operational also without this change. To carry out an adaptation to the actual constructional design, accordingly, it suffices to change said dimensions of the first conductor segment 41 or the second conductor segment 42, which is comparatively easy to carry out, also in the incorporated state, for example by means of laser trimming, i.e. removal of part of the relevant segment 41, 42 by means of a laser beam.

In a practical realization of this second antenna, the dimensions of the substrate 1 are approximately 17×11×2.0 $mm^3$. The material chosen for the substrate 1 has a dielectric constant $\in_r$=21.55 and a tan δ value of $1.17\times10^{-4}$. This corresponds approximately to the high-frequency properties of a commercially available NP0-K21 ceramic material. The printed conductor track was manufactured from silver paste and has a total length of approximately 55.61 mm. The width of the conductor portions is approximately 0.75 mm, while the dimensions of the rectangular metal surface 39 at the end of the second conductor portion 32 are approximately 11.0×4.5 $mm^2$.

For a length of the first conductor segment 41 of 1.5 mm in the direction towards the upper surface of the substrate, the frequency of the fundamental mode is approximately 928 MHz. A reduction of the length to 0.4 mm results in a frequency of the fundamental mode of 975 MHz. This represents a change of 47 MHz, while the frequency of the first harmonic is changed by no more than 9 MHz.

Similarly, if the length of the second conductor segment 42 is approximately 0.75 mm, a frequency of the first harmonic of approximately 1828 MHz is obtained. An increase in this length to 3.75 mm gives a resonance frequency at approximately 1800 MHz. This is a change of 28 MHz, whereas the frequency of the fundamental mode has a shift of less than 1 MHz then.

FIG. 4 diagrammatically shows a printed circuit board (PCB) 100 on which the antenna 110 was provided by surface mounting (SMD) together with other components in the regions 120 and 130 of the printed circuit board 100. This is done by means of planar soldering in a wave soldering bath or a reflow soldering process, whereby the soldering points (footprints) 21 to 25 as well as the feed terminal 40 are connected to corresponding solder points on the board 100. One of the electrical connections created thereby is that between the feed terminal 40 and a conductor track 111 on the printed circuit board 100, via which connection the electromagnetic energy to be radiated is provided.

FIG. 5 shows a third embodiment of the antenna 110 according to the invention which is shown mounted on a printed circuit board 100. Here, again, identical or similar elements have been given the same reference numerals as in FIG. 4, so that a repeated description thereof can be omitted and only the differences will be explained.

In this third embodiment, a second conductor track structure 60, 61 is provided in addition to a first conductor track structure 51, 52 on the substrate 1, which second structure is supplied through a joint feed terminal 40 and a joint feed terminal 45. The feed terminal 40 in this embodiment lies at a long, first side face 11 of the substrate 1 and is soldered to the conductor track 111.

Connected to the feed terminal 40 is a feed line 45, which extends along the circumference of the substrate 1 at the first, second, and third side faces 11, 12, 13 and then in the direction to the upper, first surface of the substrate at the opposed, third side face 13, approximately halfway the length thereof, so as to supply the first metal conductor track structure present on this upper surface. This structure comprises a first conductor portion 51 extending in a direction towards the first side face 11 and a second conductor portion in the form of a first, substantially rectangular metal surface or patch 52 connected to the end of the first conductor portion.

Furthermore, a first tuning stub line 53 extends from the feed terminal 40 at the first side face 11 of the substrate 1 in the form of a second substantially rectangular metal surface in a direction opposed to the feed line 45 and is designed for tuning the first metal conductor track structure 50, 51 to a first operating frequency band. Furthermore, a second tuning stub line 54 for a second operating frequency band extends along the third and fourth side faces 13, 14 of the substrate and is connected to the end of the feed line 45.

The feed line 45 supplies the second metal conductor track structure 60, 61, which is provided for operating the antenna in a third frequency band, approximately halfway the length of the second side face 12. This latter structure comprises a third conductor portion 61 extending in a direction towards the fourth side face 14 as well as a third substantially rectangular metal surface or patch 62 connected to the end thereof. If so desired, tuning stub lines may be printed also for this second conductor track structure 60, 61, but this is not the case here.

The first conductor track structure 51, 52 in this embodiment serves for tuning and operating the antenna in the GSM900 and GSM1800 bands, while the second conductor track structure 61, 62 is designed for operating the antenna in the BT (Bluetooth) band at 2480 MHz.

The position and length of the first metal surface 52 and of the first conductor portion 51 on the upper surface of the substrate 1 here substantially determine the impedance adaptation to 50 Ω as well as the positions of the resonance frequencies relative to one another. These frequencies are chosen such that the fundamental mode lies in the GSM900 band and the first harmonic in the GSM1800 band (as in the first and second embodiment of the antenna). The tuning of the impedance adaptation and of the two resonance frequencies to suit the concrete constructional situation, which is also dependent, for example, on the type of the housing and its influence on the resonance behavior, here takes place by means of the two tuning stub lines 53, 54. Shortening of these stub lines (for example through laser trimming), leads to a shift of the two resonance frequencies to higher values, whereby at the same time a more critical coupling of the microwave energy can be achieved.

A suitable positioning and dimensioning of the third metal surface 62 leads to a tuning of the resonance frequency of this structure to the BT band, while obviously other frequency bands (for example PCS1900 or UMTS) may also be covered for alternative applications.

The particular advantage of this embodiment, apart from the possibility of surface mounting, the particularly small dimensions, and the other advantages mentioned above, is that a three-band operation is possible with this antenna in a correspondingly designed mobile telephone device.

In a practical realization of this third embodiment of the antenna, the substrate 1 had the dimensions 15×10×3 $mm^3$. The resonance frequencies of this antenna were 943 MHz for the GSM band, 1814 MHz for the GSM1800 (DCS) band, and 2480 MHz for the BT band. The reflection coefficient curve R shown in FIG. 6 as a function of the frequency F shows that the bandwidths of the resonances are sufficiently great for operating the antenna in the three bands. It was furthermore found that the same resonance frequencies can also be achieved with a substrate having the dimensions 13×10×2 $mm^3$, whereby a volume reduction of 42.2% is achieved in comparison with the substrate mentioned earlier.

What is claimed is:

1. A microwave antenna, comprising:

a substrate (1);

a first conductor track (51, 52) formed on an exterior of said substrate (1), said first conductor track (51, 52) for operating the microwave antenna in one of a first operating frequency band and a second operating frequency band;

a second conductor track (61, 62) formed on said exterior of said substrate (1), said second conductor track (61, 62) for operating the microwave antenna in a third operating frequency band;

a feed line (45) formed on an exterior of said substrate (1), said feed line (45) being connected to said first conductor track (51, 52) and said second conductor track (61, 62); and a feed terminal (40) formed on an exterior of said substrate (1), said feed terminal (40) being connected to said feed line (45).

2. The microwave antenna of claim 1, wherein said first conductor track (51, 52) includes:

a first conductor (51) formed on said exterior of said substrate (1) and connected to said feed line (45); and a first metal surface (52) formed on said exterior of said substrate (1) and connected to said first conductor (51).

3. The microwave antenna of claim 1, wherein said second conductor track (61, 62) includes:

a second conductor (61) formed on said exterior of said substrate (1) and connected to said feed line (45); and a second metal surface (62) formed on said exterior of said substrate (1) and connected to said second conductor (61).

4. The microwave antenna of claim 1, further comprising:

a first tuning stub (54) formed on said exterior of said substrate (1), said first tuning stub (54) for tuning said first conductor track (51, 52) to the first operating frequency band.

5. The microwave antenna of claim 4, further comprising:

a second tuning stub (53) formed on said exterior of said substrate (1), said second tuning stub (53) for tuning said first conductor track (51, 52) to the second operating frequency band.

6. The microwave antenna of claim 1, wherein said substrate (1) includes a side surface (11);

wherein at least a portion of said feed line (45) is parallel to said side surface (11); and wherein at least a portion of said first conductor track (51, 52) is nonparallel to said side surface (11).

7. The microwave antenna of claim 1, wherein said substrate (1) includes a side surface (14);

wherein at least a portion of said feed line (45) is parallel to said side surface (14); and wherein at least a portion of said second conductor track (61, 62) is nonparallel to said side surface (14).

8. The microwave antenna of claim 1, wherein said substrate (1) includes a side surface (13);

wherein at least a portion of said feed line (45) is formed on said side surface (13); and wherein at least a portion of said first conductor track (51, 52) is adjacent to said side surface (11).

9. The microwave antenna of claim 1, wherein said substrate (1) includes a side surface (12);

wherein at least a portion of said feed line (45) is formed on said side surface (12); and wherein at least a portion of said second conductor track (61, 62) is adjacent to said side surface (12).

10. A microwave antenna, comprising:

a substrate (1) including a side surface (11);

a first conductor track (51, 52) formed on an exterior of said substrate (1), wherein at least a portion of said first conductor track (51, 52) is nonparallel to said side surface (11);

a second conductor track (61, 62) formed on said exterior of said substrate (1), wherein at least a portion of said second conductor track (61, 62) is nonparallel to said side surface (11);

a feed line (45) formed on said exterior of said substrate (1), said feed line (45) being connected to said first conductor track (51, 52) and said second conductor track (61, 62), wherein at least a portion of said feed line (45) is parallel to said side surface (11); and a feed terminal (40) formed on an exterior of said substrate (1), said feed terminal (40) being connected to said feed line (45).

11. The microwave antenna of claim 10, wherein said first conductor track (51, 52) includes:

a first conductor (51) formed on said exterior of said substrate (1) and connected to said feed line (45); and a first metal surface (52) formed on said exterior of said substrate (1) and connected to said first conductor (51).

12. The microwave antenna of claim 10, wherein said second conductor track (61, 62) includes:

a second conductor (61) formed on said exterior of said substrate (1) and connected said feed line (45); and a second metal surface (62) formed on said exterior of said substrate (1) and connected to said second conductor (61).

13. The microwave antenna of claim 10, further comprising:

a first tuning stub (54) formed on said exterior of said substrate (1), said first tuning stub (54) for tuning said first conductor track (51, 52) to a first operating frequency band.

14. The microwave antenna of claim 13, further comprising:

a second tuning stub (53) formed on said exterior of said substrate (1), said second tuning stub (53) for tuning said first conductor track (51, 52) to a second operating frequency band.

15. A microwave antenna, comprising:

a substrate (1) including a first side surface (13);

a first conductor track (51, 52) formed on an exterior of said substrate (1), wherein at least a portion of said first conductor track (51, 52) is adjacent said first side surface (13);

a second conductor track (61, 62) formed on said exterior of said substrate (1);

a feed line (45) formed on said exterior of said substrate (1), said feed line (45) being connected to said first conductor track (51, 52) and said second conductor track (61, 62), wherein at least a portion of said feed line (45) is formed on said first side surface (13); and a feed terminal (40) formed on an exterior of said substrate (1), said feed terminal (40) being connected to said feed line (45).

16. The microwave antenna of claim 15, wherein said first conductor track (51, 52) includes:

a first conductor (51) formed on said exterior of said substrate (1) and connected to said feed line (45); and a first metal surface (52) formed on said exterior of said substrate (1) and connected to said first conductor (51).

17. The microwave antenna of claim 15, wherein said second conductor track (61, 62) includes:

a second conductor (61) formed on said exterior of said substrate (1) and connected to said feed line (45); and a second metal surface (62) formed on said exterior of said substrate (1) and connected to said second conductor (61).

18. The microwave antenna of claim 15, further comprising:

a first tuning stub (54) formed on said exterior of said substrate (1), said first tuning stub (54) for tuning said first conductor track (51, 52) to a first operating frequency band.

19. The microwave antenna of claim 18, further comprising:

a second tuning stub (53) formed on said exterior of said substrate (1), said second tuning stub (53) for tuning said first conductor track (51, 52) to a second operating frequency band.

20. The microwave antenna of claim 15, wherein said substrate (1) further includes a second side surface (12); and wherein at least a portion of said second conductor track (61, 62) is adjacent said second side surface (12).

* * * * *